US006499477B1

(12) United States Patent
Brock

(10) Patent No.: US 6,499,477 B1
(45) Date of Patent: Dec. 31, 2002

(54) MULTI-PURPOSE WAR GAME DEVICE

(75) Inventor: Nathan R. Brock, Rte. 2, Box 2155 Oak Valley Rd., Toccoa, GA (US) 30577

(73) Assignee: Nathan R. Brock, Toccoa, GA (US)

( * ) Notice: Subject to any disclaimer, the term of this patent is extended or adjusted under 35 U.S.C. 154(b) by 0 days.

(21) Appl. No.: 09/609,612

(22) Filed: Jul. 5, 2000

(51) Int. Cl.[7] ..... F41B 11/00; F41B 11/06

(52) U.S. Cl. ..... 124/56; 124/59; 124/69; 42/76.01

(58) Field of Search ..... 124/69, 56, 59, 124/73, 76, 74; 89/7; 42/76.01, 77; 102/401; 434/11, 16

(56) References Cited

U.S. PATENT DOCUMENTS

| | | | | | |
|---|---|---|---|---|---|
| 599,549 | A | * | 2/1898 | Breath | 89/7 |
| 2,304,841 | A | * | 12/1942 | Mikkelsen | 124/70 |
| 3,329,063 | A | * | 7/1967 | Ehrenburg et al. | 89/1.801 |
| 3,777,382 | A | * | 12/1973 | Brunelle | 227/10 |
| 3,951,038 | A | * | 4/1976 | Van Langenhoven | 102/702 |
| 4,079,675 | A | | 3/1978 | Beumel, Jr. | 102/8 |
| 4,122,775 | A | | 10/1978 | Held | 102/8 |
| 4,150,656 | A | * | 4/1979 | Curran | 124/74 |
| 4,291,665 | A | * | 9/1981 | Bash et al. | 124/56 |
| 4,559,737 | A | * | 12/1985 | Washington | 102/504 |
| 4,570,607 | A | * | 2/1986 | Stokes | 124/56 |
| 4,690,061 | A | | 9/1987 | Armer, Jr. et al. | 102/401 |
| 4,944,521 | A | | 7/1990 | Greeno | 273/428 |
| 5,333,594 | A | * | 8/1994 | Robinson | 124/56 |
| 5,590,886 | A | | 1/1997 | Lusy | 473/577 |
| 5,660,160 | A | * | 8/1997 | Prescott, Jr. | 124/70 |
| 5,877,448 | A | | 3/1999 | Denton et al. | 102/401 |
| 5,909,000 | A | * | 6/1999 | Rakov | 102/440 |
| 5,996,503 | A | | 12/1999 | Woodall et al. | 102/498 |
| 6,003,504 | A | * | 12/1999 | Rice et al. | 124/73 |
| 6,151,824 | A | * | 11/2000 | Clayton | 124/69 |
| 6,311,681 | B1 | * | 11/2001 | Snyder, Jr. | 124/59 |

* cited by examiner

*Primary Examiner*—Charles T. Jordan
*Assistant Examiner*—John W. Zerr
(74) *Attorney, Agent, or Firm*—Paul E. Knowlton; Cynthia R. Parks; Kilpatrick Stockton LLP

(57) ABSTRACT

A reuseable war game device launches paint-balls or liquid colorant or both simultaneously, and can be aimed and fired while hand-held, can be concealed and aimed but remotely triggered, is easy to dismantle and repair under field conditions, is durable enough to withstand all field conditions, and is concealable, compact and easily portable. The device comprises a launch housing that includes a launch barrel joined to a rotatable muzzle assembly that is fixed on a target; a chamber housing that includes a charge chamber which receives and stores a charge; a hammer chamber that includes a retractable hammer that when released from a cocked position is thrust toward the charge chamber; a trigger that is drawn to retract the hammer to the cocked position; and, a check valve located between the launch barrel and the charge chamber that permits flow only from the charge chamber to the launch housing.

19 Claims, 3 Drawing Sheets

MULTI-PURPOSE WAR GAME DEVICE

TECHNICAL FIELD

The present invention relates generally to small simulated weapons, used in the course of military training exercises or recreational war games, that discharge solid or liquid projectiles.

BACKGROUND ART

The military has long engaged in simulated war games as a method of training personnel in the arts of weaponry and combat. More recently, non-military personnel have been engaged in simulated war games as a form of recreation. Whether military or non-military, those engaged in such games use weapons that launch benign colorant projectiles as a means of identifying another whom has been 'hit' and is therefore eliminated from the game.

Colorant projectiles are available in the form of paint-balls that may be fired from various spring-loaded or compressed-gas charged devices. Colorant projectiles are also available in liquid form. Presently, it is known to fire paint-balls from devices that resemble pistols, rifles, hand grenades and land mines. It is also known to launch liquid colorant from devices that resemble hand grenades and land mines.

Beyond hand-held pistols and rifles that fire single paint-balls in succession, attempts have been made to develop simulated war game weapons that provide the user with a tactical advantage. For example, it is known to provide reusable compressed-gas charged grenades that can simultaneously launch many paint-balls at an adversary in an effort to simulate the fragmentation of an exploding hand grenade. Also, it is known to provide a reusable compressed-gas charged land mine that simultaneously launches groups of paint-balls in a 360° radius. In addition, it is known to provide a reusable compressed-gas charged land mine that sprays liquid colorant in a 360° radius upon being tripped by a war game participant.

The primary thrust of the known prior art devices is to provide specialized, single function weapons that discharge either solid or liquid colorant projectiles. Because of their specialized nature the existing devices do not offer the user a choice between launching only paint-balls, launching only liquid colorant, or launching both simultaneously. Nor do the known existing devices offer the user a choice between safely holding and firing the device, or concealing the device like a land mine that is aimed to launch colorant projectiles only at the anticipated adversary. Finally, many of the known prior art devices are not concealable nor is it easy to carry many simultaneously.

Thus, there is a need in the art for a reuseable war game device that launches paint-balls or liquid colorant or both simultaneously, can be aimed and fired by the user while hand-held, can be concealed and aimed but remotely triggered, is easy and inexpensive to manufacture, is easy and inexpensive to charge, is easy to dismantle and repair under field conditions, is durable enough to withstand all field conditions, is concealable, is compact, and is easily portable.

SUMMARY OF THE INVENTION

The present invention overcomes the deficiencies of the known prior art devices by providing a reuseable war game device that launches paint-balls or liquid colorant or both simultaneously, can be aimed and fired by the user while hand-held, can be concealed and aimed but remotely triggered, is easy to dismantle and repair under field conditions, is durable enough to withstand all field conditions, and is concealable, compact and easily portable.

Generally speaking the weapon is divided into two main sections, a chambers housing and a launch housing. The launch housing includes a launch barrel connected at both ends by elbows. These elbows are rotatable 360° about a longitudinal axis. Connected to each first elbow is a second elbow. Each second elbow is rotatable 360° about a second longitudinal axis.

Together, the launch barrel and elbows store the projectiles. Projectiles exit the weapon via the launch ports, the open end of the second elbows. The launch ports are aimed by rotating both the first and second elbows, about the respective axes, toward the target. This combination of multiple elbows provides any firing alignment desired by the user.

Covering each launch port is a removable end cap. During storage and transportation each end cap remains in place.

The housings are removably connected. The connection between the housings includes a check valve. The check valve permits flow only from the chambers housing to the launch housing. In this regard, the check valve prohibits liquid projectile from migrating to the chambers housing.

The chamber housing comprises two distinct chambers. The charge chamber contains the power or charge that launches the projectiles. The hammer chamber contains a hammer assembly, namely a hammer, hammer spring, trigger and safety pin.

To safely fire the weapon while hand-held, the user draws back the trigger by pulling the hold portion and then securing the retainer portion about the retainer seat. The action of drawing back the trigger compresses the hammer spring. The user then inserts the safety pin. Next the elbows are rotated so that the launch ports point toward the target(s) and the end caps are removed. The user then releases the retainer from the retainer seat. All that is necessary to fire the weapon and launch the projectiles is to aim and remove the safety pin.

Alternately, to safely fire the weapon while hand-held, the user rotates the elbows toward the target(s), removes the end caps, aims the weapon, draws back the trigger so that the hammer spring is sufficiently compressed and then releases the trigger.

To set the weapon so that it may be triggered by an adversary to fire upon that adversary, such as when the trigger is released by a trip wire, the user plants or otherwise secures the weapon to a surface. The user then draws back the trigger and secures the retainer about the seat. The user inserts the safety pin to secure the hammer in the cocked position, rotates the elbows so that the launch ports aim at the anticipated target(s) and removes the end caps. The user sets a remote trigger such as a trip wire that will cause the retainer to release from the seat. The user then removes the safety pin and all that is necessary to fire the weapon and launch projectiles is to have the trip wire engage.

Whether the weapon is fired while hand-held or set and tripped by another, the projectiles exit the launch port through the same sequence of events. When the hammer is released from the cocked position the hammer spring uncoils, throwing the hammer toward the container. The pointed ram hits and ruptures the thin seal at the top of the container causing the compressed-gas to violently escape in the usual manner. The escaping gas pushes open the check valve and passes into the launch barrel. The forces exerted by the gas push the projectiles at rapid speed out the launch ports and toward their intended target(s).

DETAILED DESCRIPTION

Figure 1:
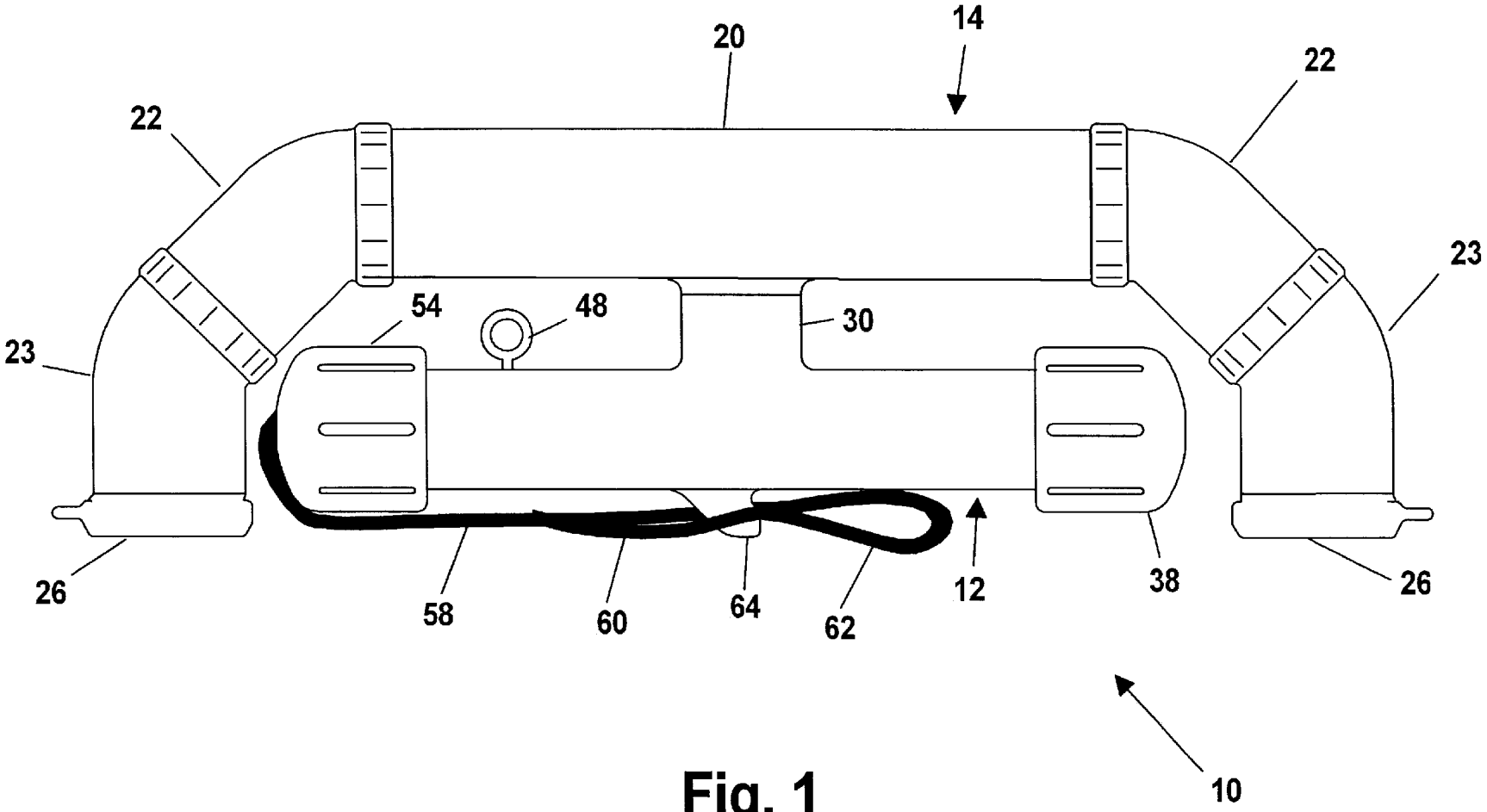
FIG. 1 is a top view of a war game device according to one embodiment of the present invention, shown in a folded and secured position.
Figure 2:
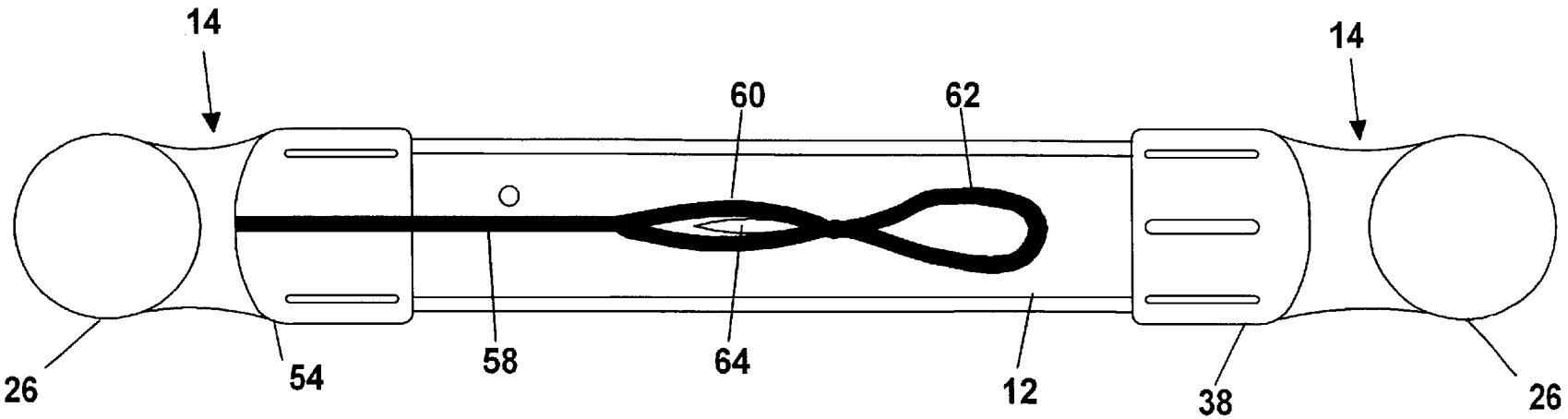
FIG. 2 is a side view of a war game device according to one embodiment of the present invention, shown in a folded and secured position.

Referring now to the drawings, wherein like numerals refer to like parts throughout the several views, FIG. 1 shows a top view of a war game weapon 10 embodying the present invention. In FIG. 1 the weapon 10 is illustrated in the folded configuration as it would be for safe storage or carrying. FIG. 2 shows a side view of the weapon 10 also in the folded configuration.

Generally speaking the weapon 10 is divided into two main sections, the chamber housing 12 and the launch housing 14. As explained below in detail, the chamber housing 12 contains the trigger, firing assembly and charge while the launch housing 14 contains the colorant projectiles. War game weapons launch benign colorant projectiles as a means of identifying another whom has been 'hit' and is therefore eliminated from the game.

Figure 3:
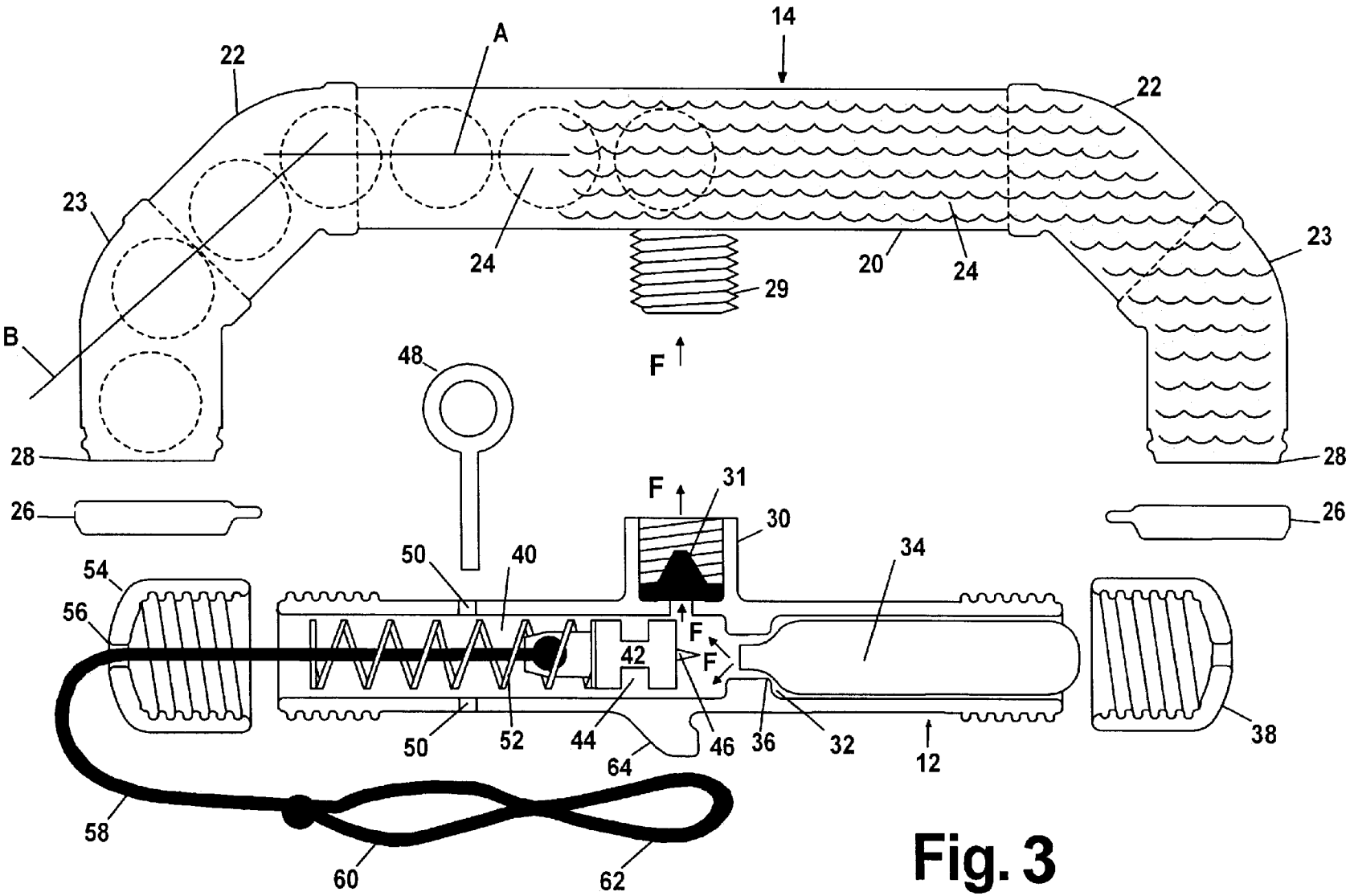
FIG. 3 is a longitudinal cross-section view of a war game device according to one embodiment of the present invention with the chambers housing shown in cross section and representative projectiles illustrated by dashed line for solids and wavy lines for liquids.

As best illustrated in FIG. 3, the launch housing 14 comprises a number of parts. In the illustrated embodiment, the launch barrel 20 is a generally straight portion which is connected at both ends to two separate muzzle assemblies. Embodiments with fewer or more muzzle assemblies are contemplated. Here, a muzzle assembly is comprised of two 45° elbows 22, 23. The first elbows 22 are joined to the launch barrel 20 such that the first elbows 22 are rotatable 360° about the longitudinal axis A. Connected to each first elbow 22 at the end opposite the connection to the launch barrel 20, is a second elbow 23. Each second elbow 23 is joined to a respective first elbow 22 such that the second elbows 23 are, in one embodiment, rotatable 360° about the longitudinal axis B. However, embodiments allowing less then 360° rotation are contemplated.

The launch barrel/elbow and elbow/elbow connections are formed, as known by those skilled in the art, to provide an easy disconnect while maintaining a pressure resistant liquid tight seal. In the illustrated embodiment, friction-fit bell and spigot joint ends form these connections. The combination of multiple elbows 22, 23 provides any firing alignment desired by the user.

Together, the launch barrel 20 and elbows 22, 23 form a combination hold/launch barrel that stores the projectiles 24. As noted above, both military training exercises and recreational war games use non-lethal colorants as projectiles to mark 'hits'. Paint-balls and liquid are two popular forms of colorant projectiles. For the purposes of this description, all forms of non-lethal colorant projectiles are referred to as projectiles 24. Nevertheless, while this description is directed to non-lethal projectiles, it will be understood that the term projectile extends to include injury-inflicting lethal projectiles.

Each elbow 23 is configured, at the end opposite the connection to the elbow 22, to securely engage an end cap 26. In the illustrated embodiment, the elbow 23 and end cap 26 are both threaded to mate and provide a pressure resistant liquid tight seal. During storage and transportation each end cap 26 is connected to a respective elbow 23. In this manner the projectiles 24 are contained, even in the event a cocked weapon is inadvertently discharged. As explained below in greater detail, projectiles 24 exit the weapon 10 via launch ports 28. The launch ports 28 are aimed, as explained above, by rotating elbows 22, 23 about the respective axes A, B.

The launch housing 14 and chambers housing 12 are joined together using methods well known to those skilled in the art. For example, in the illustrated embodiment the housings 12, 14 are mated with threaded connections. Because the weapon 10 is easily disassembled, maintenance and replacement is accomplished quickly and efficiently.

In this embodiment, the launch housing 14 and chamber housing 12 are connected via an outside threaded nipple 29 attached to the launch housing 14, that mates with an inside threaded bushing 30 attached to the chamber housing 12. Like the connections described above, this connection is also configured to provide a pressure resistant liquid tight seal.

The connection between the launch housing 14 and chamber housing 12 includes a check valve 31. As explained in detail below, the check valve 31 preferably only permits flow F from the chamber housing 12 to the launch housing 14. In this regard, the check valve 31 prohibits liquid projectile 24 from migrating to the chamber housing 12.

The chamber housing 12 comprises two distinct chambers. The charge chamber 32 contains the power or charge that launches the projectiles 24. In this embodiment, the charge is compressed-gas in the well known $CO^2$ container 34. The typical $CO^2$ container is cylindrical, includes a rounded bottom and is of uniform diameter except at the top where the container tapers to a small neck and top. The container 34 is inserted into the chamber 32. To secure the container 34 the chamber 32 includes support shoulders 36. The container 34 is nested against the shoulders 36 and retained within the chamber 32 by the end cap 38. In this embodiment, the housing 12 is threaded to mate with the end cap 38 which is likewise threaded.

The hammer chamber 40 contains a hammer assembly comprising a hammer 42 and the associated spring-loaded trigger mechanism. The hammer 42 includes a safety pin receiver 44 and ram 46. In this embodiment, the hammer 42 is shaped like an hour-glass with a pointed end. Here the area of narrowest dimension is the safety pin receiver 44 and the pointed end is the ram 46. In FIG. 3 the hammer 42 is shown in the uncocked position. That is, the hammer 44 is loose and not poised to rupture the container 34 causing the compressed-gas contents to discharge.

In the cocked position (not illustrated), the hammer 42 is drawn back and held within the hammer chamber 40 at the end opposite the location illustrated in FIG. 3. In the cocked position the safety pin 48 is engaged by inserting it into a first safety pin orifice 50 so that it extends across the safety pin receiver 44 and through a second safety pin orifice 50. When engaged in this manner, the safety pin will securely hold the hammer 42 in place.

In the cocked position, the hammer spring 52 is compressed between the hammer 42 and the hammer chamber end cap 54. Like the charge chamber end cap 38, the end cap 54 is also threaded to mate with the threaded end of chamber housing 12. The hammer chamber end cap 54 includes a trigger orifice 56 which permits passage of the trigger 58.

The orifices 50, 56 as illustrated are configured to function as safety valves that permit compressed-gas to escape in the event of an unintentional discharge. In an alternative embodiment, the orifices 50, 56 may be sealed to prevent the entry of debris, moisture and ambient air. Such an alternative embodiment may include a separate safety valve.

In this embodiment, the trigger 58 is a flexible member surrounded partially by the hammer spring 52 and attached to the hammer 42. At a distal end the trigger 58 includes a retainer portion 60 and a hold portion 62. When cocked, the trigger 58 is held in the cocked position by securing the retainer portion 60 around the retainer seat 64 as best shown in FIGS. 1 and 2.

Operation

Generally, as best shown in FIGS. 1 and 2, the weapon 10 may be stored or transported with the charge container 34 and projectiles 24 in place by leaving the hammer 42 in the uncocked position. In other words, the weapon 10 may be stored or carried with the safety pin 48 in place and the retainer 60 over the seat 64 but without the hammer spring 52 being compressed. Generally, to launch the projectiles 24, the user may handhold and fire the weapon 10 or conceal and set the weapon 10 to be tripped by others.

As best described with reference to FIG. 3, to fire the weapon 10 while hand-held, the user grasps the chambers housing 12 generally around that section which houses the container 34. The user then draws back the trigger 58 by pulling the hold portion 62 and securing the retainer portion 60 about the retainer seat 64. The action of drawing back the trigger 58 retracts the hammer 42 and compresses the hammer spring 52. The hammer spring 52 is now fully compressed and the hammer 42 is in the cocked-position. The user then inserts the safety pin 48, as described above, to secure the hammer 42 in the cocked position. Next the elbows 22, 23 are rotated so that the launch ports 28 point toward the target(s), and the end caps 26 removed. The user then releases the retainer 60 from the retainer seat 64. At this time, all that is necessary to fire the weapon 10 and launch the projectiles 24 is to aim and remove the safety pin 48 from the engaged position.

Alternately, to fire the weapon 10 and launch projectiles 24 while the weapon is hand-held, the user grasps the chambers housing 12, rotates the elbows 22, 23 toward the target(s), removes the end caps 26, aims the weapon 10, draws back the trigger 58 so that the hammer spring 52 is sufficiently compressed and then releases the trigger 58.

To set the weapon 10 so that it may be triggered by an adversary to fire upon that adversary, such as when the trigger 58 is released by an engaged trip wire (not shown), the user plants or otherwise secures the weapon 10 to a surface (not shown). Suitable horizontal surfaces, by way of illustration and not limitation, include earthen ground, fallen trees, finished and unfinished exterior paths, and the interior floors and ceilings of a structure. Suitable vertical surfaces include trees, the exterior of structures, and the interior walls of structures, just to name a few examples.

To set the planted weapon 10, the user secures it to the surface by fastening around the chambers housing 12, threaded bushing 30, or launch barrel 20. In an alternative embodiment, mounts may be provided for receiving fasteners that permit connecting to a surface. The user draws back the trigger 58 by pulling the hold portion 62 and securing the retainer 60 about the seat 64. The hammer spring 52 is now fully compressed and the hammer 42 is in the cocked position. The user then inserts the safety pin 48, as described above, to secure the hammer 42 in the cocked position. Next the elbows 22, 23 are rotated so that the launch ports 28 aim at the anticipated target(s), and the end caps 26 removed.

The user sets a remote trigger such as a trip wire (not shown) which, when engaged, will cause the retainer 60 to release from the seat 64. The user then removes the safety pin 48 from the engaged position. All that is necessary to fire the weapon 10 and launch projectiles 24 is to have the trip wire engage.

Alternatively, the user does not secure the retainer 60 about the seat 64 but inserts the safety pin 48 which is then connected to a trip wire. All that is necessary to fire the weapon 10 and launch the projectiles 24 is to have the trip wire 66 engage.

The illustrated embodiment includes a trip wire. However, it is considered that other remote trigger mechanism may be incorporated such as, by way of illustration and not limitation, pressure pads, shock indicators, sound detectors, and light beams connected to a means for releasing the retainer 60, releasing the safety pin 48, or retracting the retainer seat 64.

Whether the weapon 10 is fired while hand-held or set and tripped by another, the projectiles 24 exit the launch port 28 through the same sequence of events. When the hammer 42 is released from the cocked position the hammer spring 52 uncoils, throwing the hammer 42 toward the container 34. The pointed ram 46 hits and ruptures the thin seal at the top of the container 34 causing the compressed-gas to violently escape in the usual manner. The escaping gas rushes past the hammer 42, pushes open the check valve 31, and passes into the launch barrel 20 as indicated by the flow arrows F. The forces exerted by the gas push the projectiles 24 at rapid speed out the launch ports 28 and toward their intended target(s).

In the case of discrete projectiles 24 such as paint-balls, the projectiles will be launched successively without interruption. That is, as a unit, like shrapnel. In the case of liquid, the projectile 24 will be launched en masse. It is considered that where only liquid projectile is launched, a shield (not shown) may cover the launch ports 28 to create a spray pattern or otherwise control the speed and direction of the liquid projectile 24.

Generally, the materials selected to construct the weapon 10 should be selected to endure harsh battlefield conditions. Heavy schedule PVC and non-corrosive metals are likely design choices.

While the present invention in its various aspects has been described in detail with regard to a preferred embodiment, alternative embodiments are considered. It should be understood that variations, modifications and enhancements can be made to the disclosed apparatus and procedures without departing from the scope of the present invention as defined in the appended claims.

What is claimed is:

1. A projectile launching device, comprising:

a chamber housing including a charge chamber, a hammer chamber, and a trigger;

a launch housing operatively associated with the chamber housing, and including a launch barrel and a muzzle assembly rotatably attached to said launch barrel and, a check valve located between said launch barrel and said charge chamber;

wherein said check valve prevents flow of a liquid projectile into said chamber housing.

2. The device of claim 1, wherein said rotatable muzzle assembly is fixed on a target and positioned to launch projectiles.

3. The device of claim 2, wherein said projectiles are a non-lethal colorant.

4. The device of claim 2, wherein said projectiles are lethal.

5. The device of claim 1, wherein said charge chamber receives and stores a charge.

6. The device of claim 5, wherein said charge is a reservoir of releasable compressed gas.

7. The device of claim 1, wherein said hammer chamber further comprises a retractable hammer that, when released from a cocked position, is thrust toward said charge chamber.

8. The device of claim 1, wherein said muzzle assembly comprises a first elbow rotatably and operatively associated with said launch barrel, and a second elbow rotatably and operatively associated with said first elbow.

9. The device of claim 1, wherein said check valve permits flow only from said charge chamber to said launch housing.

10. A projectile launching device, comprising:

a chamber housing including a charge chamber, a hammer chamber, and a trigger, where said hammer chamber further comprises a retractable hammer that, when released from a cocked position, is thrust toward said charge chamber, and where said hammer is retracted to said cocked position by drawing said trigger;

a launch housing including a launch barrel and a muzzle assembly rotatably attached to said launch barrel; and a check valve located between said launch barrel and said charge chamber.

11. A projectile launching device, comprising:

a chamber housing that includes a charge chamber which receives and stores a charge, a hammer chamber that includes a retractable hammer that when released from a cocked position is thrust toward said charge chamber, and a trigger that is drawn to retract said hammer to said cocked position;

a launch housing that includes a launch barrel joined to a rotatable muzzle assembly that is positioned on a target; and a check valve located between said launch barrel and said charge chamber that permits flow only from said charge chamber to said launch housing.

12. A projectile launching device, comprising:

a chamber housing including a charge chamber, a hammer chamber, and a trigger, where said hammer chamber further comprises a retractable hammer that, when released from a cocked position, is thrust toward said charge chamber, and where said hammer is retained in said cocked position by securing said trigger, and released by unsecuring said trigger;

a launch housing including a launch barrel and a muzzle assembly rotatably attached to said launch barrel; and a check valve located between said launch barrel and said charge chamber.

13. A projectile launching device, comprising:

a chamber housing including a charge chamber, a hammer chamber, and a trigger, where said hammer chamber further comprises a retractable hammer that, when released from a cocked position, is thrust toward said charge chamber, and where said hammer is retained in a cocked position by inserting a safety pin and released by removing said safety pin;

a launch housing including a launch barrel and a muzzle assembly rotatably attached to said launch barrel; and a check valve located between said launch barrel and said charge chamber.

14. A method of aiming and launching projectiles from a device which includes a check valve located between a launch housing and a charge chamber, comprising:

securing said device to a surface;

loading projectiles into said launch housing;

inserting a charge into said charge chamber;

retracting and securing a hammer;

rotating a muzzle assembly to aim at a target;

setting a remote means for unsecuring said hammer; and, engaging said means for unsecuring said hammer.

15. The method of claim 14, wherein said step of rotating a muzzle assembly further comprises the step of rotating a plurality of muzzle assemblies.

16. The method of claim 14, wherein said step of setting a remote means for unsecuring further comprises the step of connecting said means to said hammer.

17. The method of claim 14, wherein said step of engaging further comprises the step of unsecuring said hammer.

18. The method of claim 17, wherein said step of unsecuring further comprises the step of striking a charge.

19. A method of aiming and launching projectiles from a device, which includes a check valve located between a launch housing and a charge chamber, comprising:

providing a launching device comprising a launch barrel and a muzzle assembly rotatably attached to said launch barrel;

positioning said launch barrel in a first orientation;

aiming said muzzle assembly in a second orientation; and firing a charge that pushes said projectiles through said muzzle assembly;

wherein said step of providing further comprises providing a launch barrel and a plurality of muzzle assemblies rotatably attached to said launch barrel.

* * * * *